US011335250B2

(12) United States Patent
Yin

(10) Patent No.: US 11,335,250 B2
(45) Date of Patent: May 17, 2022

(54) PIXEL DRIVING CIRCUIT AND DISPLAY PANEL

(71) Applicant: WUHAN CHINA STAR OPTOELECTRONICS TECHNOLOGY CO., LTD., Wuhan (CN)

(72) Inventor: Weihong Yin, Wuhan (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 17/251,371

(22) PCT Filed: May 28, 2020

(86) PCT No.: PCT/CN2020/092754
§ 371 (c)(1),
(2) Date: Dec. 11, 2020

(87) PCT Pub. No.: WO2021/196382
PCT Pub. Date: Oct. 7, 2021

(65) Prior Publication Data

US 2022/0051611 A1 Feb. 17, 2022

(30) Foreign Application Priority Data

Apr. 2, 2020 (CN) ..... 202010257945.7

(51) Int. Cl.
*G09G 3/32* (2016.01)

(52) U.S. Cl.
CPC ..... *G09G 3/32* (2013.01); *G09G 2300/0426* (2013.01); *G09G 2300/089* (2013.01);
(Continued)

(58) Field of Classification Search
CPC .. G09G 3/2003; G09G 3/2092; G09G 3/2096; G09G 3/32–3291;
(Continued)

(56) References Cited

U.S. PATENT DOCUMENTS

2009/0225016 A1 9/2009 Lai et al.
2011/0127991 A1 6/2011 Senda et al.
(Continued)

FOREIGN PATENT DOCUMENTS

CN 106710524 A 5/2017
CN 108766341 A 11/2018
(Continued)

*Primary Examiner* — Nathan Danielsen
(74) *Attorney, Agent, or Firm* — The Roy Gross Law Firm, LLC; Roy Gross

(57) ABSTRACT

A pixel driving circuit is provided, and the pixel driving circuit includes a light-emitting driving circuit, a photosensitive driving circuit, a micro light-emitting diode, and a photoelectric conversion device, wherein when the pixel driving circuit is in a display mode, the light-emitting driving circuit drives the micro light-emitting diode to emit light for display, and when the pixel drive circuit is in a photosensitive display mode, the photosensitive driving circuit drives the photoelectric conversion device to generate a photocurrent, and when the photocurrent is received by the micro light-emitting diode, the micro light-emitting diode will emit light for display. Functions of electronic devices may be integrated into a display panel to achieve full-screen display.

16 Claims, 2 Drawing Sheets

(52) U.S. Cl.
CPC ..... *G09G 2300/0842* (2013.01); *G09G 2320/0233* (2013.01); *G09G 2360/142* (2013.01); *G09G 2360/144* (2013.01)

(58) Field of Classification Search
CPC ... G09G 2300/0426; G09G 2300/0465; G09G 2300/0809; G09G 2300/0819; G09G 2300/0833–0847; G09G 2300/0861; G09G 2300/0871; G09G 2300/088–0895; G09G 2320/0233; G09G 2320/0242; G09G 2320/0271; G09G 2320/0276; G09G 2320/04; G09G 2320/06; G09G 2320/0626; G09G 2320/0633; G09G 2320/0666; G09G 2320/0686; G09G 2320/08; G09G 2360/14–144
See application file for complete search history.

(56) References Cited

U.S. PATENT DOCUMENTS

| | | | | |
|---|---|---|---|---|
| 2017/0140702 | A1 | 5/2017 | Li et al. | |
| 2019/0035328 | A1* | 1/2019 | Jung | G09G 3/3225 |
| 2020/0027402 | A1* | 1/2020 | Xiao | G09G 3/3258 |
| 2021/0225965 | A1* | 7/2021 | Liu | G09G 3/3266 |

FOREIGN PATENT DOCUMENTS

| | | | |
|---|---|---|---|
| CN | 109671384 | A | 4/2019 |
| CN | 110568649 | A | 12/2019 |

* cited by examiner

PIXEL DRIVING CIRCUIT AND DISPLAY PANEL

CROSS REFERENCE TO RELATED APPLICATIONS

This application is a National Phase of PCT Patent Application No. PCT/CN2020/092754 having International filing date of May 28, 2020, which claims the benefit of priority of Chinese Application No. 202010257945.7 filed on Apr. 2, 2020. The contents of the above applications are all incorporated by reference as if fully set forth herein in their entirety.

TECHNICAL FIELD

The present invention relates to a display technology field, and in particular to a pixel driving circuit and a display panel having a display mode and a photosensitive display mode.

BACKGROUND

With development of display technology, users' requirements for a high screen-to-body ratio have gradually increased. Panel manufacturing companies have gradually proposed a variety of different types of display panels to increase a proportion of a display area. Recently, a trend of full-screens is to further integrate sensors such as fingerprint identification sensors, cameras, face identification sensors, and distance sensing sensors into display panels, so that the display panels have gradually transitioned from a simple display interface to a comprehensive perception interactive interface. For example, a frontal camera function is required in a mobile phone, and with increasing requirements for the screen-to-body ratio, it is necessary to reserve a hole 11 or notched area 12 on a display panel of the mobile phone as a photosensitive area of the camera (as shown in FIG. 1), but this results in a reduction of display area proportions. Therefore, it is necessary to solve the problems existing in the prior art.

TECHNICAL PROBLEM

An object of the present invention is to provide a pixel driving circuit and a display panel having a display mode and a photosensitive display mode to solve problems in the prior art.

TECHNICAL SOLUTION

To achieve the object described above, a first aspect of the present invention provides a pixel driving circuit, comprising:

a micro light-emitting diode, configured to emit light for display;

a photoelectric conversion device, electrically connected to the micro light-emitting diode through a circuit node and configured to convert external light into a photocurrent;

a light-emitting driving circuit, configured to drive the micro light-emitting diode, wherein the light-emitting driving circuit at least comprises a first switch that is controlled by a first enable signal, the first switch is connected between an input voltage and the circuit node, and the micro light-emitting diode is connected between the circuit node and a reference voltage; and a photosensitive driving circuit, configured to drive the photoelectric conversion device, wherein the photosensitive driving circuit at least comprises a second switch that is controlled by a second enable signal, and the second switch and the photoelectric conversion device are connected between the input voltage and the circuit node;

wherein when the first switch is in a turned-on state and the second switch is in a turned-off state, the photoelectric conversion device is disabled, and the micro light-emitting diode is driven by the light-emitting driving circuit to emit light for display to make the pixel driving circuit be in a display mode; and wherein when the first switch is in a turned-off state and the second switch is in a turned-on state, the photoelectric conversion device is driven by the photosensitive driving circuit to generate the photocurrent, and the photocurrent is received by the micro light-emitting diode to emit light for display to make the pixel driving circuit be in a photosensitive display mode.

Further, when the first enable signal is at a high potential, the second enable signal is at a low potential; when the first enable signal is at the low potential, the second enable signal is at the high potential.

Further, the light-emitting driving circuit further comprises:

a first terminal of a third switch is configured to receive a data signal source, and a second terminal of the third switch is configured to receive a scan signal source; and a first terminal of a fourth switch is electrically connected to the input voltage and a second terminal of the fourth switch is electrically connected to a third terminal of the third switch;

wherein a first terminal of the first switch is electrically connected to a third terminal of the fourth switch, a second terminal of the first switch is configured to receive the first enable signal, a third terminal of the first switch is electrically connected to a first terminal of the micro light-emitting diode, and a second terminal of the micro light-emitting diode is electrically connected to the reference voltage.

Further, the first switch, the second switch, the third switch, and the fourth switch are thin film transistors.

Further, the light-emitting driving circuit further comprises:

a first terminal of a storage capacitor is electrically connected to the third terminal of the third switch and the second terminal of the fourth switch, and a second terminal of the storage capacitor is electrically connected to the input voltage.

Further, the fourth switch is in a constantly-turned-on state due to the storage capacitor.

Further, when the pixel driving circuit is in the display mode, all of the first switch, the third switch, and the fourth switch are all in the turned-on state.

Further, a first terminal of the second switch is electrically connected to the input voltage, a second terminal of the second switch is configured to receive the second enable signal, a third terminal of the second switch is electrically connected to a second terminal of the photoelectric conversion device, a first terminal of the photoelectric conversion device is connected to the circuit node, and the photosensitive driving circuit further comprises:

a first terminal of a fifth switch is electrically connected to the circuit node, a second terminal of the fifth switch is configured to receive a reset signal source, and a third terminal of the fifth switch is electrically connected to the reference voltage.

Further, the fifth switch is a thin film transistor.

Further, when the pixel driving circuit is in the photosensitive display mode, the fifth switch is turned on to reset the micro light-emitting diode, and then the fifth switch is turned off and the second switch is turned on to make the photoelectric conversion device generate the photocurrent.

Further, the light-emitting driving circuit comprises a circuit with a uniformity compensating function, the circuit is disposed at a front end of the pixel driving circuit to receive a data signal, and the circuit is configured to compensate signals received by the micro light-emitting diode.

Further, the photosensitive driving circuit comprises an electrical signal amplifying module, and the electrical signal amplifying module is disposed between the micro light-emitting diode and the photoelectric conversion device and is configured to enhance an intensity of a light-responsive current generated by the photoelectric conversion device.

Further, the pixel driving circuit is disposed in a thin film transistor array substrate comprising the first and the second switches, and an anode terminal of the micro light-emitting diode is electrically connected to a drain terminal of the first switch through a bonding layer, wherein a material of the bonding layer is one of a metal material or a metal alloy.

Further, an anode terminal of the photoelectric conversion device is electrically connected to a drain terminal of the second switch through a material of an active layer of the second switch.

Further, an anode terminal of the photoelectric conversion device is electrically connected to a drain terminal of the second switch through the bonding layer.

Further, a material of the anode terminal of the photoelectric conversion device is a transparent conductive thin film.

A second aspect of the present invention provides a display panel, comprising any aspect of the pixel driving circuit described above.

BENEFICIAL EFFECT

In the present invention, by disposing a pixel driving circuit, a micro light-emitting diode, and a photoelectric conversion device in pixels, different driving operations may be performed to emit light for display according to a display mode and a photosensitive display mode of the micro-light emitting diode, to realize that functions of electronic devices are integrated into a display panel without specifically reserving areas for the electronic devices to achieve full-screen display.

DETAILED DESCRIPTION OF PREFERRED EMBODIMENTS

In order to make objectives, technical solutions and effects of the present invention more clear and specific, the present application is described in further detail below with reference to appending drawings. It should be understood that specific embodiments described herein are only used to explain the present invention and are not intended to limit the present invention.

The following descriptions for respective embodiments refer to the appending drawings to illustrate embodiments of the present invention that can be implemented. Spatially relative terms mentioned in the present invention refer only to directions referring to the appending drawings. Therefore, the used spatially relative terms is configured to illustrate and understand the present invention, not to limit the present invention.

Figure 1:
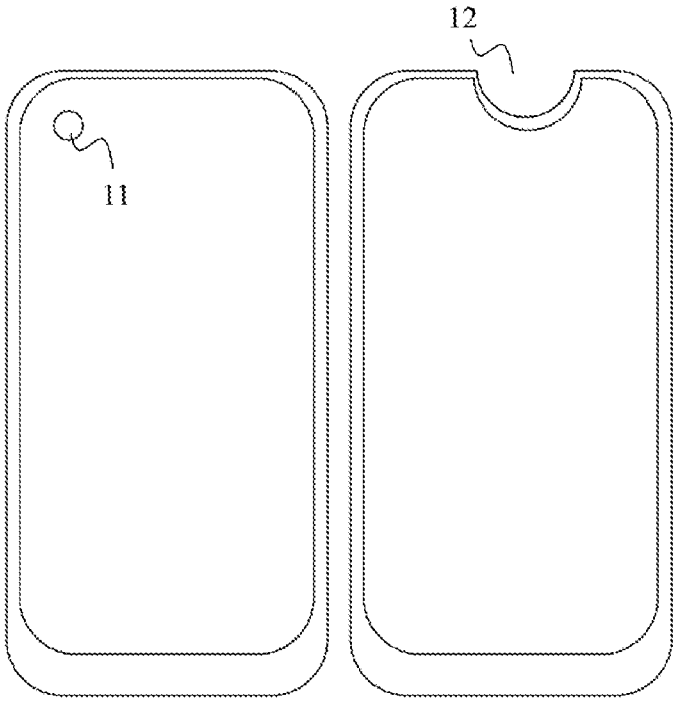
FIG. 1 is a schematic diagram showing a mobile terminal having a reserved hole or notched area.
Figure 2:
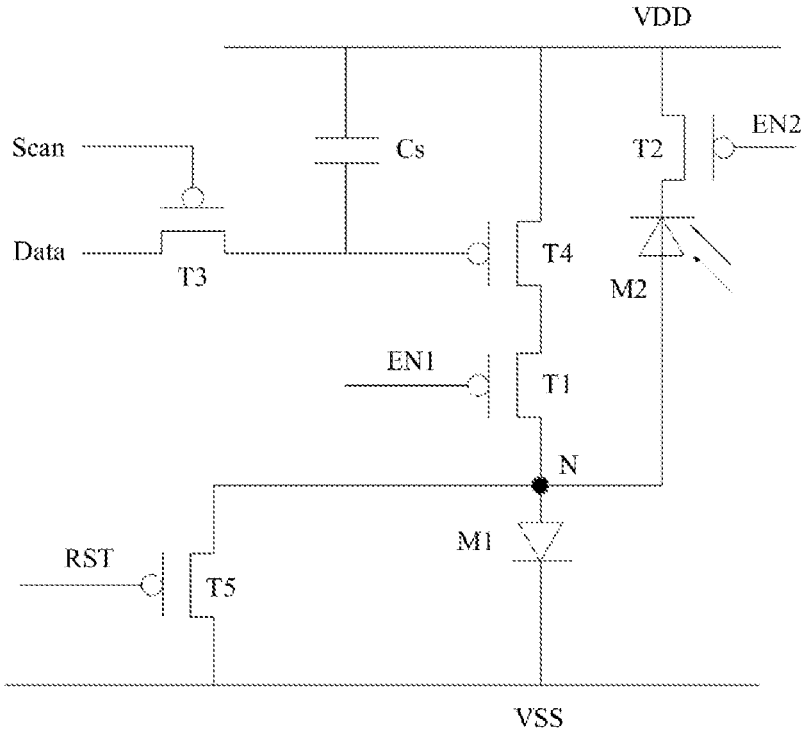
FIG. 2 is a schematic diagram showing a pixel driving circuit according to a first embodiment of the present invention.

Referring to FIG. 2, it is a schematic diagram showing a pixel driving circuit according to a first embodiment of the present invention. The pixel driving circuit includes a light-emitting driving circuit (not shown), a photosensitive driving circuit (not shown), a micro light-emitting diode M1, and a photoelectric conversion device M2. In the present embodiment, the micro-light emitting diode M1 is configured to emit light for display. The photoelectric conversion device M2 is electrically connected to the micro-light emitting diode M1 through a circuit node N to convert external light into a photocurrent. The light-emitting driving circuit is configured to drive the micro-light-emitting diode M1, and the light-emitting driving circuit is configured to drive the photoelectric conversion device M2. Wherein, the light-emitting driving circuit at least includes a first switch T1 that is controlled by a first enable signal EN1, and the first switch T1 is connected between an input voltage VDD and the circuit node N. The micro light-emitting diode M1 is connected between the circuit node N and a reference voltage VSS. The photosensitive driving circuit includes at least a second switch T2 that is controlled by a second enable signal EN2, and the second switch T2 and the photoelectric conversion device M2 are connected between the input voltage VDD and the circuit node N.

In the present embodiment, the light-emitting driving circuit specifically includes three switches (T1, T3, and T4) and a storage capacitor Cs. The photosensitive driving circuit specifically includes two switches (T2 and T5). Each of the switches includes a first terminal, a second terminal, and a third terminal, and all of the five switches may be thin film transistors (TFTs), so that each of the switches have a source terminal, a drain terminal, and a gate terminal, which correspond to the first terminal, the second terminal, and the third terminal, respectively. It can be understood that the first terminal may be the source terminal or the drain terminal. If the first terminal is the source terminal, the third terminal is the drain terminal, and vice versa. Generally, a terminal connected to an input voltage is the source terminal, and another terminal is the drain terminal. For the sake of convenience in describing, the switches of the present invention are preferably p-type transistors, and this will be used to illustrate, but should not be explained as a limitation to the present invention.

In the present embodiment, pixels in a display panel may have a display mode used for receiving data signals and a photosensitive display mode with electronic device functions. That is, it is realized that functions of electronic devices (such as cameras) may be integrated into the display panel without specifically reserving holes or notched areas as photosensitive areas, thereby increasing a screen-to-body ratio. For the sake of convenience in describing, a camera function shown as an example below.

Specifically, the light-emitting driving circuit further includes: the third switch T3, a first terminal of the third switch T3 is configured to receive a data signal source Data, a second terminal of the third switch T3 is configured to receive a scan signal source Scan, and a third terminal of the third switch T3 is electrically connected to a second terminal of the fourth switch T4 and a first terminal of the storage capacitor Cs, wherein the scan signal source Scan is a potential signal coming from a scan line, and an input of a potential signal of the data signal source Data is controlled by the potential signal coming from the scan line. A fourth switch T4, a first terminal of the fourth switch T4 is electrically connected to an input voltage VDD, the second terminal of the fourth switch T4 is electrically connected to the third terminal of the third switch T3 and the first terminal of the storage capacitor Cs, and a third terminal of the fourth switch T4 is electrically connected to a first terminal of a first switch T1. A storage capacitor Cs, the first terminal of the storage capacitor Cs is electrically connected to the third terminal of the third switch T3 and the second terminal of the fourth switch T4 and a second terminal of the storage capacitor Cs is electrically connected to the input voltage VDD, wherein the first terminal of the first switch T1 is electrically connected to the third terminal of the fourth switch T4, a second terminal of the first switch T1 is configured to receive the first enable signal EN1, and a third terminal of the first switch T1 is electrically connected to a first terminal of the micro-light emitting diode M1. A potential signal of the first enable signal EN1 is configured to control a turned-on state and turned-off state of the first switch T1.

Furthermore, the first terminal of the micro light-emitting diode M1 (anode) is electrically connected to the third terminal of the fourth switch T4, and a second terminal of the micro light-emitting diode M1 (cathode) is electrically connected to the reference voltage VSS. When the pixel driving circuit is in a display mode, that is, in a case that the camera function is not activated, potential signals of the scan signal source Scan and the first enable signal EN1 are at a high potential, it represents the first switch T1, the third switch T3, and the fourth switch T4 are in an turned-on state. In one embodiment, a voltage difference between the second terminal (gate electrode terminal) of the fourth switch T4 and the first terminal of the fourth switch T4 connected to the input voltage VDD may be kept by means of the storage capacitor Cs, so that the fourth switch T4 is in a constantly-turned on state. Therefore, the first terminal of the micro-light emitting diode M1 may be connected to the input voltage VDD with high potential, forming a forward bias voltage, and may receive the potential signal coming from the data signal source Data to emit light for display.

Specifically, the photosensitive driving circuit further includes: a second switch T2, a first terminal of the second switch T2 is electrically connected to the input voltage VDD, a second terminal of the second switch T2 is configured to receive the second enable signal EN2, and a third terminal of the second switch T2 is electrically connected to a first terminal of the photoelectric conversion device M2. The fifth switch T5, a first terminal of the fifth switch T5 is electrically connected to the circuit node N, a second terminal of the fifth switch T5 is configured to receive a reset signal source RST, and a third terminal of the fifth switch T5 is electrically connected to the reference voltage VSS, wherein a potential signal of the second enable signal EN2 is configured to control an turned-on state and turned-off state of the second switch T2, a potential signal of the reset signal source RST is configured to control an turned-on state and turned-off state of the fifth switch T5 to reset a potential of the micro light-emitting diode M1. It can be understood that based on the above-mentioned description, the circuit node N is a common intersection point between the third terminal of the first switch T1, the first terminal of the fifth switch T5, the first terminal of the micro light-emitting diode, and the second terminal of the photoelectric conversion device.

Furthermore, the first terminal of the micro light-emitting diode M1 is electrically connected to the circuit node N, the second terminal of the micro light-emitting diode M1 is electrically connected to the reference voltage VSS. The first terminal (anode) of the photoelectric conversion device M2 is electrically connected to the third terminal of the second switch T2, and the second terminal (cathode) of the photoelectric conversion device M2 is electrically connected to the circuit node N. When the pixel driving circuit is in the photosensitive display mode, that is, in a case that the camera function is activated, the potential signal of the reset signal source RST is at a high potential to turn on the fifth switch T5 first to reset the potential of the micro light-emitting diode M1, then the fifth switch T5 is turned off. Then, a potential signal of the second enable signal EN2 is at a high potential to turn on the second switch T2, and first terminal of the photoelectric conversion device M2 may be connected to the input voltage VDD with a high potential, to make the photoelectric conversion device M2 form a reverse bias voltage, so that when the photoelectric conversion device M2 detects external light, the incident light is converted into a photocurrent, and when the photocurrent is received by the micro light-emitting diode M1, a light-emitting display is performed.

In summary, since the display mode and the photosensitive display mode are different driving operations, when the pixel driving circuit is in the display mode (that is, the camera function is not activated), the scan signal source Scan and the first enable signal EN1 are at high potentials, the second enable signal EN2 and the reset signal source RST are at low potentials, which indicates that the first switch T1, the first third switch T3, and the fourth switch T4 is in a turned-on state, so that the first terminal of the micro light-emitting diode M1 may be connected to the input voltage VDD with a high potential and receives the potential signal of the data signal source Data to emit light for display. Since the second switch T2 and the fifth switch T5 are in an turned-off state, the first terminal of the photoelectric conversion device M2 cannot be connected to the input voltage VDD to convert a photocurrent, resulting in the photoelectric conversion device M2 is disabled. In addition, when the pixel driving circuit is in the photosensitive display mode (that is, the camera function is activated), the first enable signal EN1 is at a low potential, and the reset signal source RST and the second enable signal EN2 are at high potentials, which indicates that the first switch T1 is in an turned-off state, so that the first terminal of the micro light-emitting diode M1 cannot be connected to the input voltage VDD and receive the potential signal of the data signal source Data (whether or not the third switch T3 and the fourth switch T4 are in turned-on states). Furthermore, because the second switch T2 and the fifth switch T5 are in turn-on states, the potential of the micro light-emitting diode M1 is reset, then the first terminal of the photoelectric conversion device M2 is connected to the input voltage VDD with a high potential to convert a photocurrent, and when the photocurrent is received by the micro light-emitting diode M1, a light-emitting display is performed.

Figure 3:
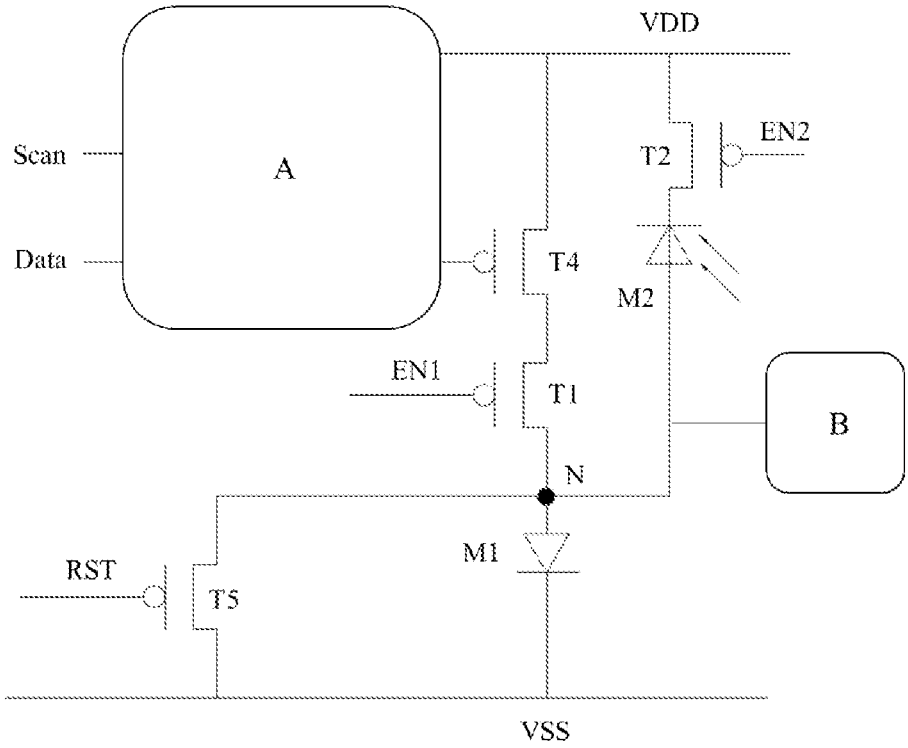
FIG. 3 is a schematic diagram showing a pixel driving circuit having a circuit with a uniformity compensating function and an electrical signal amplifying module according to the first embodiment of the present invention.

In one embodiment, the light-emitting driving circuit may further include a circuit with a uniformity compensating function to compensate signals received by the micro light-emitting diode M1, such as a circuit with a brightness compensating function not affected by a threshold voltage, and the circuit with the uniformity compensating function may be composed of a plurality of thin film transistors. The circuit with the uniformity compensating function may be disposed at a front end of the pixel driving circuit (area A shown in FIG. 3), that is, after inputting input signals (such as the input voltage VDD and the potential signal of the data signal source Data), they will be compensated by the circuit with the uniformity compensating function, and then it will be determined whether transmitting compensated signals to the micro light-emitting diode M1 by depending on turned-on and turned-off states of the first switch T1 (the turned-on and turned-off states are determined according to the display mode and the photosensitive display mode), so that it not only will not affect the driving modes of the pixel driving circuit, but also may optimize signals received by the micro light-emitting diode M1.

In one embodiment, the photosensitive driving circuit may further include an electrical signal amplifying module to enhance intensity of a light-responsive current generated by the photoelectric conversion device M2, thereby improving performance. The electrical signal amplifying module may be disposed between the first terminal of the micro light-emitting diode M1 and the second terminal of the photoelectric conversion device M2 (area B shown in FIG. 3). That is, when the photoelectric conversion device M2 generates a photocurrent, intensity of the photocurrent will be enhanced by the electrical signal amplifying module, and then the photocurrent is transmitted to the micro light-emitting diode M1. It can be understood that the electrical signal amplifying module may be composed of a plurality of resistors, a plurality of capacitors, a plurality of inductors, and even a plurality of thin film transistors, which are not specifically limited herein.

Figure 4:
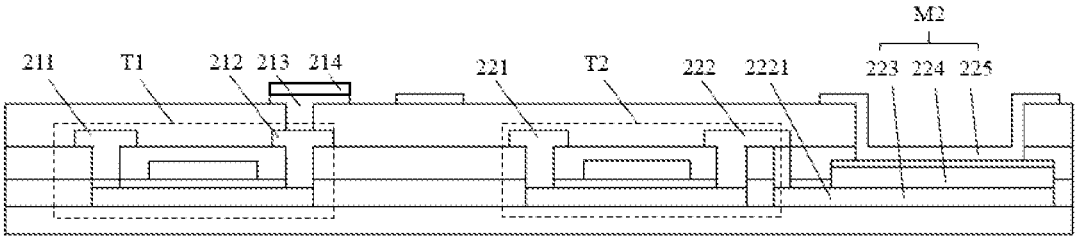
FIG. 4 is a schematic diagram showing a thin-film transistor array substrate according to a second embodiment of the present invention.
Figure 5:
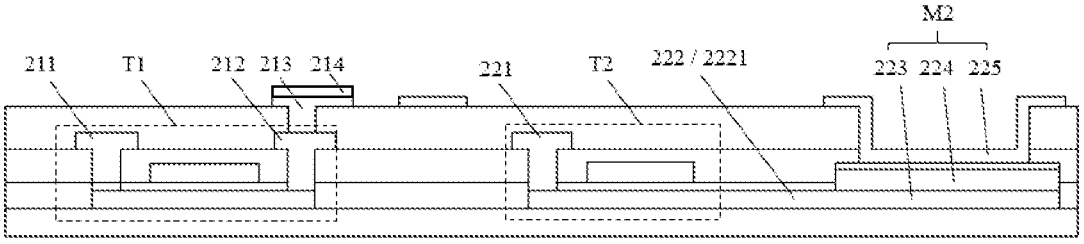
FIG. 5 is a schematic diagram showing a thin-film transistor array substrate according to a third embodiment of the present invention.
Figure 6:
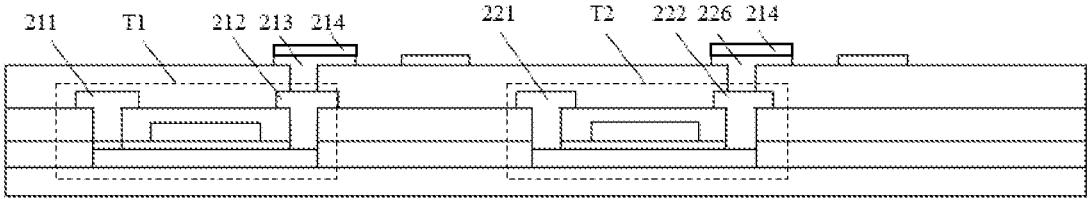
FIG. 6 is a schematic diagram showing a thin-film transistor array substrate according to a fourth embodiment of the present invention.

In conjunction with FIGS. 4 to 6, which are schematic diagrams showing thin-film transistor array substrates according to second to fourth embodiments of the present invention. In the present invention, the micro light-emitting diode M1 and the photoelectric conversion device M2 may be integrated into a thin film transistor array substrate in different ways.

In the second embodiment (as shown in FIG. 4), the thin film transistor array substrate includes the first switch T1 and the second switch T2. Wherein, the first switch T1 has a first source terminal 211, a first drain terminal 212, and a first anode electrode 213 which is electrically connected to the first drain terminal 212. The first source terminal 211 is equivalent to the first terminal of the first switch T1 described in the first embodiment, which is a terminal point for inputting signals (the potential signals of the input voltage VDD and the Data signal source Data are input herein), and the input signals are controlled by the first enable signal EN1. The first drain terminal 211 is equivalent to the third terminal of the first switch T1 described in the first embodiment, which is electrically connected to a first anode electrode 213 of the micro light-emitting diode M1 (equivalent to the first terminal of the micro light-emitting diode M1 described above). Further, the micro light-emitting diode M1 (not shown in FIG. 4) may be transferred with a thin film transfer technology to bond with the first anode electrode 213. In one embodiment, the micro light-emitting diode M1 is bond with the first anode electrode 213 through a bonding layer 214. The bonding layer 214 is formed of a metal or a metal alloy, and is also used for bonding an epitaxial substrate of the micro light-emitting diode M1 and a carrier substrate. It can be understood that the present invention does not specifically limit materials of the bonding layer. The second switch T2 has a second source terminal 221 and a second drain terminal 222, the second source terminal 221 is equivalent to the first terminal of the second switch T2 described in the first embodiment, which is a terminal point for inputting a signal (the input voltage VDD is input herein), and the input signal is controlled by the second enable signal EN2. The second drain terminal 222 is equivalent to the third terminal of the second switch T2 described in the first embodiment, which is electrically connected to a second anode electrode 223 of the photoelectric conversion device M2 (equivalent to the first terminal of the photoelectric conversion device M2 described above). Furthermore, the photoelectric conversion device M2 may be prepared simultaneously with a plurality of thin film transistors (including the first switch T1 and the second switch T2) of the thin film transistor array substrate, that is, while preparing active layers of the plurality of thin film transistors, for example, a polysilicon 2221 having doped ions and capable of being conductive is prepared to be used as the second anode electrode 223 for extracting holes, and then a photoelectric conversion layer 224 and a second cathode electrode 225 (equivalent to the second terminal of the photoelectric conversion device M2 described above) used for extracting electrons are sequentially formed on the polysilicon 2221 to form the photoelectric conversion element M2, so that the second anode electrode 223 is electrically connected to the second drain electrode 222 by the polysilicon 2221. In order to allow light to be received by the photoelectric conversion layer 224 to convert a photocurrent, the second cathode electrode 225 is composed of a transparent conductive film (such as indium tin oxide).

In the third embodiment (as shown in FIG. 5), a difference between the third embodiment and the second embodiment is that: since both of the second drain electrode 222 and the polysilicon 2221 are used for conductive, the second drain electrode 222 may be replaced by the polysilicon 2221 to make the second anode electrode 223 to be directly electrically connected to the second drain electrode 222 replaced by the polysilicon 2221. That is, the input signal (the input voltage VDD is input herein) directly passes through the polysilicon 2221 to make the photoelectric conversion device M2 to generate a photocurrent after the second switch T2 receives the second enable signal EN2 to turn on.

In the fourth embodiment (as shown in FIG. 6), a difference between the fourth embodiment and the second embodiment is that: the photoelectric conversion device M2 (not shown in FIG. 6) is also bonded with the second switch T2 in a bonding manner. Specifically, the second drain terminal 222 are electrically connected to a third anode electrode 226 through the bonding layer 214, wherein the third anode electrode 226 serves as an electrode used for extracting holes in the photoelectric conversion device M2.

In the present invention, by disposing the pixel driving circuit, the micro light-emitting diode, and the photoelectric conversion device in the pixels, the different driving operations may be performed to emit light for display according to the display mode and the photosensitive display mode of the micro-light emitting diode, to realize that the functions of the electronic devices are integrated into the display panel without specifically reserving areas for the electronic devices to achieve full-screen display.

Although the present invention has been disclosed above in the preferred embodiments, the above preferred embodiments are not intended to limit the present invention. For persons skilled in this art, various modifications and alterations can be made without departing from the spirit and scope of the present invention. The protective scope of the present invention is controlled by the scope as defined in the claims.

What is claimed is:

1. A pixel driving circuit, comprising:

a micro light-emitting diode, configured to emit light for display;

a photoelectric conversion device, electrically connected to the micro light-emitting diode through a circuit node and configured to convert external light into a photocurrent;

a light-emitting driving circuit, configured to drive the micro light-emitting diode, wherein the light-emitting driving circuit at least comprises a first switch that is controlled by a first enable signal, the first switch is connected between an input voltage and the circuit node, and the micro light-emitting diode is connected between the circuit node and a reference voltage; and a photosensitive driving circuit, configured to drive the photoelectric conversion device, wherein the photosensitive driving circuit at least comprises a second switch that is controlled by a second enable signal, and the second switch and the photoelectric conversion device are connected between the input voltage and the circuit node;

wherein when the first switch is in a turned-on state and the second switch is in a turned-off state, the photoelectric conversion device is disabled, and the micro light-emitting diode is driven by the light-emitting driving circuit to emit light for display to make the pixel driving circuit be in a display mode; and wherein when the first switch is in a turned-off state and the second switch is in a turned-on state, the photoelectric conversion device is driven by the photosensitive driving circuit to generate the photocurrent, and the photocurrent is received by the micro light-emitting diode to emit light for display to make the pixel driving circuit be in a photosensitive display mode, wherein the photosensitive driving circuit comprises an electrical signal amplifying module, and the electrical signal amplifying module is disposed between the micro light-emitting diode and the photoelectric conversion device and is configured to enhance an intensity of a light-responsive current generated by the photoelectric conversion device.

2. The pixel driving circuit as claimed in claim 1, wherein when the first enable signal is at a high potential, the second enable signal is at a low potential; when the first enable signal is at the low potential, the second enable signal is at the high potential.

3. The pixel driving circuit as claimed in claim 1, wherein the light-emitting driving circuit further comprises:

a first terminal of a third switch is configured to receive a data signal source, and a second terminal of the third switch is configured to receive a scan signal source; and a first terminal of a fourth switch is electrically connected to the input voltage and a second terminal of the fourth switch is electrically connected to a third terminal of the third switch;

wherein a first terminal of the first switch is electrically connected to a third terminal of the fourth switch, a second terminal of the first switch is configured to receive the first enable signal, a third terminal of the first switch is electrically connected to a first terminal of the micro light-emitting diode, and a second terminal of the micro light-emitting diode is electrically connected to the reference voltage.

4. The pixel driving circuit as claimed in claim 3, wherein the first switch, the second switch, the third switch, and the fourth switch are thin film transistors.

5. The pixel driving circuit as claimed in claim 3, wherein the light-emitting driving circuit further comprises:

a first terminal of a storage capacitor is electrically connected to the third terminal of the third switch and the second terminal of the fourth switch, and a second terminal of the storage capacitor is electrically connected to the input voltage.

6. The pixel driving circuit as claimed in claim 5, wherein the fourth switch is in a constantly-turned-on state due to the storage capacitor.

7. The pixel driving circuit as claimed in claim 3, wherein when the pixel driving circuit is in the display mode, the first switch, the third switch, and the fourth switch are all in the turned-on state.

8. The pixel driving circuit as claimed in claim 1, wherein a first terminal of the second switch is electrically connected to the input voltage, a second terminal of the second switch is configured to receive the second enable signal, a third terminal of the second switch is electrically connected to a second terminal of the photoelectric conversion device, a first terminal of the photoelectric conversion device is connected to the circuit node, and the photosensitive driving circuit further comprises:

a first terminal of a fifth switch is electrically connected to the circuit node, a second terminal of the fifth switch is configured to receive a reset signal source, and a third terminal of the fifth switch is electrically connected to the reference voltage.

9. The pixel driving circuit as claimed in claim 8, wherein the fifth switch is a thin film transistor.

10. The pixel driving circuit as claimed in claim 8, wherein when the pixel driving circuit is in the photosensitive display mode, the fifth switch is turned on to reset the micro light-emitting diode, and then the fifth switch is turned off and the second switch is turned on to make the photoelectric conversion device generate the photocurrent.

11. The pixel driving circuit as claimed in claim 1, wherein the light-emitting driving circuit comprises a circuit with a uniformity compensating function, the circuit is disposed at a front end of the pixel driving circuit to receive a data signal, and the circuit is configured to compensate signals received by the micro light-emitting diode.

12. The pixel driving circuit as claimed in claim 1, wherein the pixel driving circuit is disposed in a thin film transistor array substrate comprising the first and the second switches, and an anode terminal of the micro light-emitting diode is electrically connected to a drain terminal of the first switch through a bonding layer, wherein a material of the bonding layer is one of a metal or a metal alloy.

13. The pixel driving circuit as claimed in claim 12, wherein an anode terminal of the photoelectric conversion device is electrically connected to a drain terminal of the second switch through a material of an active layer of the second switch.

14. The pixel driving circuit as claimed in claim 12, wherein an anode terminal of the photoelectric conversion device is electrically connected to a drain terminal of the second switch through the bonding layer.

15. The pixel driving circuit as claimed in claim 14, wherein a material of the anode terminal of the photoelectric conversion device is a transparent conductive thin film.

16. A display panel, comprising the pixel driving circuit as claimed in claim 1.

* * * * *